United States Patent [19]

Fencl

[11] Patent Number: 4,722,216

[45] Date of Patent: Feb. 2, 1988

[54] RADIAL FORGING METHOD

[75] Inventor: Vernon R. Fencl, Northbrook, Ill.

[73] Assignee: Grotnes Metalforming Systems, Inc., Chicago, Ill.

[21] Appl. No.: 346,413

[22] Filed: Feb. 8, 1982

[51] Int. Cl.[4] ..... B21D 41/00

[52] U.S. Cl. ..... 72/402; 72/367; 72/370; 72/398; 72/76

[58] Field of Search ..... 72/402, 367, 370, 398, 72/401, 214, 189, 76, 221

[56] References Cited

U.S. PATENT DOCUMENTS

| | | | |
|---|---|---|---|
| 1,810,698 | 6/1931 | Diescher | 72/189 |
| 2,225,345 | 12/1940 | Lemoreaux | 72/402 |
| 2,256,740 | 9/1941 | Gup | 72/402 |
| 2,577,303 | 12/1951 | Bohlander | 72/76 |
| 2,617,319 | 11/1952 | Richards | 72/76 |
| 2,944,448 | 7/1960 | Broatz | 72/76 |
| 3,461,710 | 8/1969 | Luedi et al. . | |
| 3,566,651 | 3/1971 | Tlaker | 72/402 |
| 3,753,365 | 8/1973 | Kralowetz | 72/76 |
| 3,792,603 | 2/1974 | Orain | 72/402 |

OTHER PUBLICATIONS

"The Uncommon Approach to Metalforming," ©1980, Grotnes Metal-forming Systems, Inc., pp. 26–37.

*Primary Examiner*—Robert L. Spruill
*Assistant Examiner*—David B. Jones
*Attorney, Agent, or Firm*—Marshall, O'Toole, Gerstein, Murray, & Bicknell

[57] ABSTRACT

A tubular metal workpiece undergoes radial forging employing shrink forming. A multiplicity of dies are arranged circumferentially around the workpiece and urged radially inwardly in a first shrink forming pass to decrease the diameter of the workpiece. The dies are retracted, the workpiece is rotated slightly and another shrink forming pass is performed. The workpiece is then advanced axially, and the procedure described above is repeated. Procedures are employed to prevent torsional deformation and radially outward extrusion of metal in the gaps between adjacent dies.

21 Claims, 7 Drawing Figures

FIG. 1
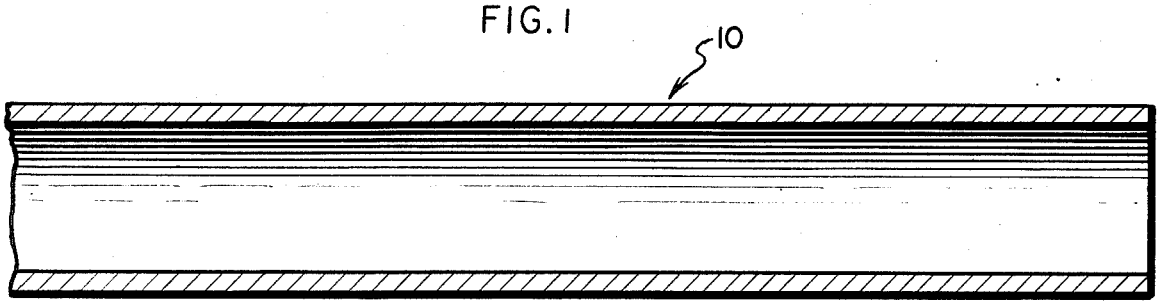
FIG. 2
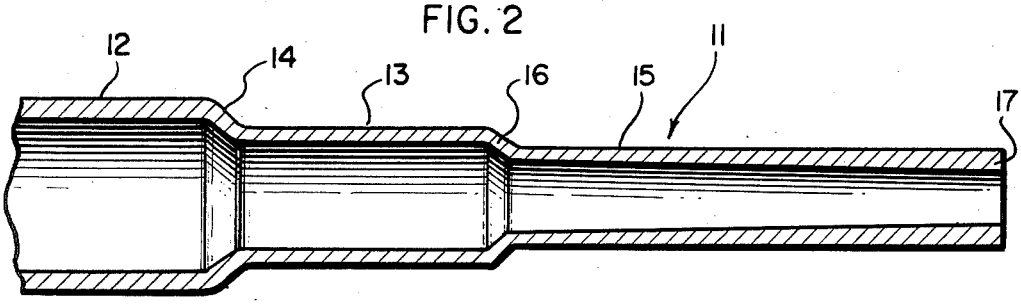
FIG. 3
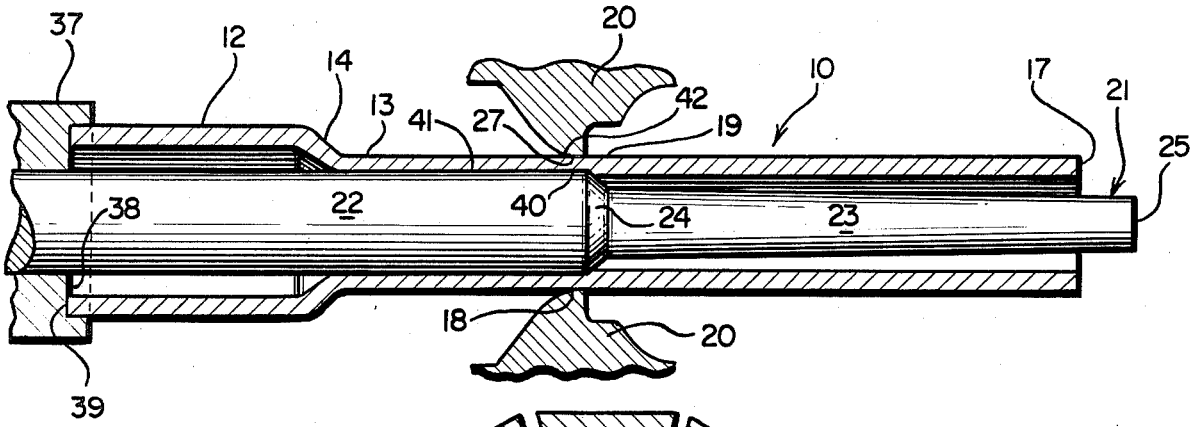
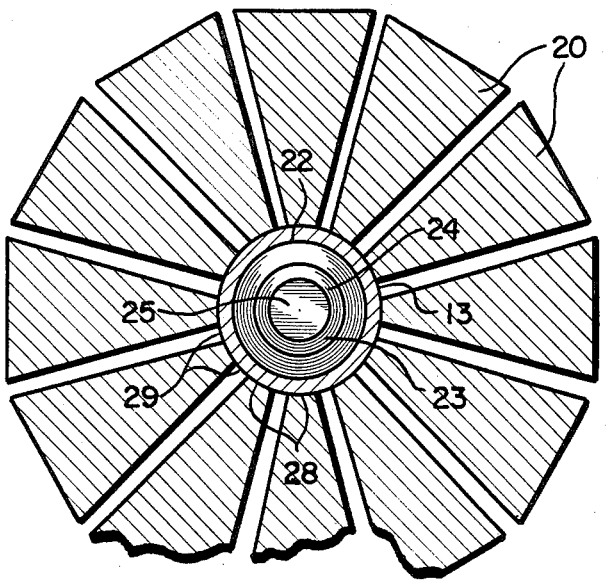
FIG. 4

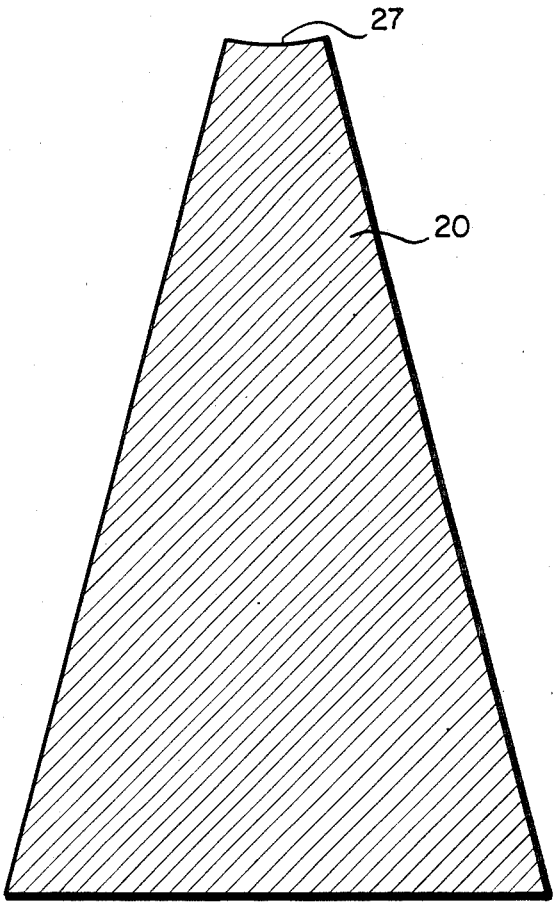
FIG. 5
FIG. 6
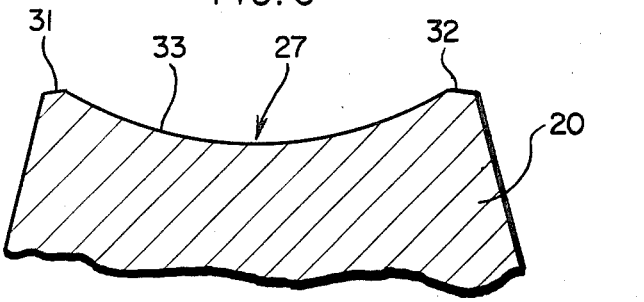
FIG. 7
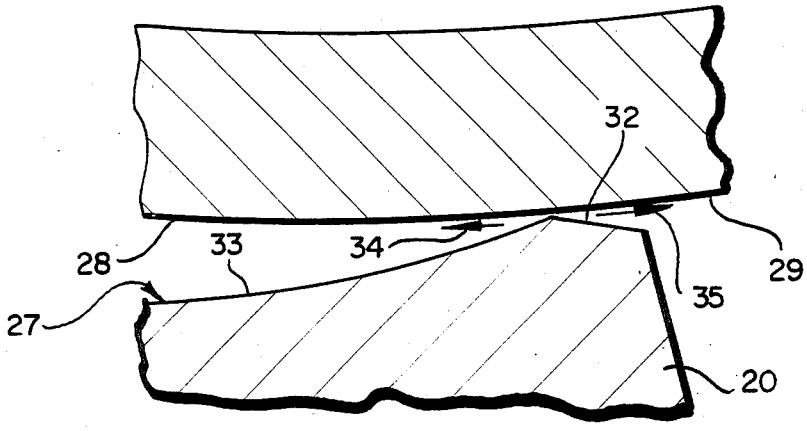

RADIAL FORGING METHOD

BACKGROUND OF THE INVENTION

The present invention relates generally to cold deforming of metal and more particularly to a method for radially forging a tubular workpiece having a circular cross section.

Conventional radial forging methods employ swaging. In swaging, a plurality of dies (e.g., 2–4 dies) rotate in steps around a tubular workpiece, delivering hammer blows to the workpiece to deform the latter to a desired outside diameter at an axial location on the workpiece aligned with the swaging dies. Alternatively, the workpiece can be rotated, in steps, while the dies remain in place, hammering the workpiece as it is rotated. Typically, the rotation is in increments of two to three degrees, until the entire workpiece, at a given axial location thereon, has been radially forged to the desired outside diameter. The workpiece is then advanced in an axial direction until another axial location on the workpiece is aligned with the dies which are then actuated to hammer at the new location on the workpiece to deform the latter to the desired outside diameter.

In swaging, the outside diameter of the workpiece is determined when the dies are all circumferentially touching at their radially inward ends at the end of a swaging operation. Thus, for a given set of swaging dies, only one outside diameter can be formed with any accuracy, and this corresponds to the diameter of the circle defined by the swaging dies when they are all circumferentially touching at their radially inward ends.

Another type of cold deforming operation is shrink forming. Shrink forming utilizes a multiplicity of circumferentially arranged dies (e.g., 12 dies) each having a curved or arcuate die face with a pair of side edges. The dies engage a tubular workpiece around its exterior, at a given axial location on the workpiece, and squeeze the exterior of the workpiece, in a first shrink forming pass, until the outside diameter of the workpiece is reduced to the desired amount. The dies then retract, and either the set of dies or the workpiece is rotated slightly. The squeezing operation is then repeated, in a second shrink forming pass. The dies then retract, and the workpiece is advanced axially until a new axial location on the workpiece is aligned with the dies which then engage and squeeze the workpiece at the new axial location.

A mandrel may be employed on the inside of the workpiece during shrink forming, and the mandrel determines the inner diameter of the workpiece at the end of the shrink forming operation. Conventionally, in shrink forming operations of the type described above, either the wall thickness or both the wall thickness and the length of the tubular workpiece increase as the outside diameter decreases. When a mandrel was employed, the increase in wall thickness and length stopped once the mandrel was contacted by the inside surface of the tubular workpiece, thus determining both the inner and outer diameters of the workpiece and its wall thickness. The wall thickness of the workpiece was not decreased in conventional shrink forming operations, either with or without an internal mandrel. The area of the workpiece engaged by the dies on a shrink forming pass (and by the mandrel at the end of the shrink forming pass) were relatively large.

An example of a shrink forming method and apparatus is disclosed in Luedi et al. U.S. Pat. No. 3,461,710, and the disclosure thereof is incorporated herein by reference.

There is normally a gap between adjacent shrink forming dies at the beginning of the shrink forming operation, and the gap decreases as the dies move radially inwardly during the shrink forming operation. This gap is at a minimum at the end of the shrink forming operation, when the workpiece has the desired outside diameter, but it is not desirable that the gap between the shrink forming dies then be totally eliminated because this may cause damage to the dies or their attachments, and there is no great benefit to have the dies exactly touch then. When dies touch, the side edges of adjacent die faces are in contact.

The unengaged surface area of the workpiece, at the gap between the dies, is relatively small compared to the surface area of the workpiece engaged by the face of a shrink forming die. This unengaged surface area of the workpiece does not undergo shrinking uniformly with the adjoining surface areas of the workpiece which are engaged by the die faces during the first shrink forming pass. Accordingly, a shrink forming operation should employ at least two passes, with either the workpiece or the set of dies being rotated relative to the other so that, on a second pass, subsequent to the first pass, the surface areas of the workpiece at the gaps between the dies, which were unengaged during the first pass, are engaged by the shrink forming die faces.

There is, however, a problem which arises when a shrink forming operation involves at least two shrink forming passes separated by a rotating step. More particularly, the arcuate die face engaging the workpiece has a curvature corresponding to the desired final outside diameter of the workpiece, whereas, at the beginning of the shrink forming operation, the workpiece has a larger outside diameter and a corresponding larger curvature than the arcuate die face. Each curved die face has a pair of side edges each adjacent a gap between dies. These side edges of the curved die face will engage the workpiece before it is engaged by that part of the curved die face between the side edges, and this will concentrate the shrink forming pressure at the two side edges, at the beginning of the shrink forming operation. As a result, metal is extruded radially outwardly in the unengaged gap between adjacent dies, during the first pass. When the dies are rotated between passes, they arrive at a position at which they can engage the previously unengaged surface areas of the workpiece, i.e. the areas containing the extruded metal. As a result, on the second pass, the metal extruded on the first pass is folded or lapped over, and this produces an imperfection in the surface of the workpiece.

Another problem which can arise when a shrink forming operation involves a pair of passes separated by a rotating step, as described above, is that the workpiece can undergo a torsional or twisting type of deformation, rather than undergoing a strictly radial type of deformation. Although torsional deformation may not change the shape of the workpiece, it is an unproductive type of deformation. It consumes work and energy and generates heat without accomplishing anything. Moreover, although straight radial deformation may require an annealing operation after a number of shrink forming passes to make the workpiece deformable again, torsional deformation requires more frequent annealing.

It would be desirable to be able to use a shrink forming operation to produce articles such as jet engine shafts having outer and inner diameters and wall thicknesses which vary in an axial direction along the shaft. Previously, such articles have been produced by extensive machining of a solid bar or a tube, inside and out, but, in such products, a middle portion thereof sometimes has a larger inner diameter than end portions thereof, and this creates difficulties in the machining operation. In addition, extensive machining is expensive and produces relatively large amounts of scrap material which is wasteful.

With swaging, an inner mandrel may be employed to obtain variations in inside diameter and to provide variations in wall thickness, but only one controlled outside diameter can be obtained with a given set of swaging dies, and if swaging is terminated before the dies circumferentially touch at their radially inward ends, there can be no control on the outside diameter with any precision.

SUMMARY OF THE INVENTION

The present invention relates to a radial forging method employing shrink forming and which eliminates the drawbacks and defects of the prior art radial forging methods described above and which enables the production of the type of article exemplified by a jet engine shaft.

The method of the present invention comprises at least two shrink forming passes by the circumferentially arranged shrink forming dies, with the dies or the workpiece being rotated relative to each other between the passes. The formation of a radially outwardly extending extrusion at the gap between adjacent dies is avoided by providing each of the dies with a die face having a predetermined cross-sectional configuration in a circumferential direction. This configuration comprises a pair of opposite end portions, each with a relatively flat configuration, and an arcuate portion therebetween. In effect, the arcuate die face is relieved at each of its end portions. Such a cross sectional configuration produces, during the first pass, metal flow initially in a circumferential direction, at each of the end portions of the die face, while avoiding the formation of a radially outwardly extending extrusion at the gap between the die faces.

Torsional deformation is avoided by controlling the rotating step between the two passes so that the angle of rotation comprises about 36% to 64% of the angular spacing between the centers of adjacent dies, said angular spacing being in the range of about 20° to 60°, depending upon the number of dies which are used.

A method in accordance with the present invention permits decreasing simultaneously both the outside diameter and the wall thickness of the workpiece during a pass. All of this occurs after the inside surface of the workpiece has been shrunk into contact with an inner mandrel. The workpiece material displaced when the wall thickness is decreased is accommodated by axial expansion.

The force available for use during the steps when the dies are urged inwardly has a predetermined maximum depending upon the capacity of the shrink forming machine in which the operation is performed. In accordance with the present invention, the surface areas of the die faces are relatively small compared to those previously used in shrink forming. As a result, there is a relatively small area of contact, at a given axial location on the workpiece, between the dies and the outside surface of the workpiece. This decreases relatively the friction in an axial direction between the outside surface of the workpiece and the dies and between the inside surface of the workpiece and the mandrel. The area of contact is controlled (by controlling the area of the die faces) so that the forces resisting axial expansion do not exceed the predetermined maximum force available for use during the steps when the dies are urged inwardly.

A workpiece having variations in outside and inside diameters and in wall thickness can be produced without changing dies. An inner mandrel having variations in diameter is employed to provide variations in the inside diameter of the workpiece. Wall thickness can be varied without varying the diameter of the mandrel, but rather by reducing the outside diameter of the workpiece, and variations in outside diameter can be obtained with a given set of dies.

Other features and advantages are inherent in the method claimed and disclosed or will become apparent to those skilled in the art from the following detailed description in conjunction with the accompanying diagrammatic drawings.

BRIEF DESCRIPTION OF THE DRAWINGS

FIG. 1 is a sectional view of a tubular workpiece before it undergoes a radial forging operation;

FIG. 2 is a sectional view of the tubular workpiece after it has undergone a radial forging operation in accordance with an embodiment of the present invention;

FIG. 3 is a sectional view illustrating a step in the radial forging method;

FIG. 4 is an end view, partially in section, illustrating a step in the radial forging method;

FIG. 5 is a sectional view of a die employed in the radial forging method;

FIG. 6 is an enlarged fragmentary sectional view of the die of FIG. 5; and FIG. 7 is a fragmentary sectional view, further enlarged, showing an end portion of the die about to engage a surface portion of the tubular workpiece.

DETAILED DESCRIPTION

Indicated generally at 10 in FIG. 1 is a tubular workpiece which is subjected to a radial forging method employing shrink forming in accordance with an embodiment of the present invention to produce a finished product indicated generally at 11 in FIG. 2.

Finished product 11 comprises a first portion 12, which is unreduced or undeformed from the dimensions of tubular workpiece 10, and which is integral with a transition portion 14 which is integral with an intermediate reduced portion 13. Portion 13 has both an outer diameter and an inner diameter less than the outer diameter of tubular workpiece 10 and also has a wall thickness less than the wall thickness of tubular workpiece 10 and of undeformed portion 12 of finished product 11. Integral with intermediate reduced portion 13 is a second transition portion 16 in turn integral with a terminal deformed portion 15 extending between second transition portion 16 and an end 17. Terminal portion 15 has both an inner diameter and an outer diameter less than the respective inner and outer diameters of intermediate reduced portion 13. The thickness of terminal deformed portion 15 increases from second transition portion 16 to end 17.

A radial forging method employing shrink forming in accordance with an embodiment of the present invention and which produces finished product 11 from tubular workpiece 10 is illustrated partially in FIGS. 3 and 4. These figures illustrate an intermediate phase of the shrink forming operation which converts tubular workpiece 10 into finished product 11. In the intermediate phase illustrated in FIG. 3, intermediate reduced portion 13 has already been formed, but terminal deformed portion 15 of the finished product has not yet been formed.

In the shrink forming operation, the tubular workpiece 10 is surrounded by a multiplicity of closely spaced, circumferentially arranged dies 20 positioned at a first predetermined axial location on the workpiece, e.g., at 18. Located inside the tubular workpiece 10 is a mandrel 21. Mandrel 21 comprises a first portion 22 which has a relatively large outside diameter and which is integral with a transition portion 24 in turn integral with a tapering portion 23 having an outside diameter less than that of first mandrel portion 22 and decreasing from transition portion 24 to a mandrel end 25.

Referring to FIG. 5, each die 20 comprises a die face 27 having a substantially arcuate cross sectional configuration. During the shrink forming operation, each die face 27 initially engages a respective one of a first group of circumferential parts 28 of the workpiece. The dies are urged radially inwardly on the workpiece, in a first pass at location 18, to reduce the outside diameter of the workpiece at that location. A second group of circumferential workpiece parts 29 are located at the gaps between adjacent die faces 27 and are unengaged during the first pass of the dies at location 18. The dimension, in a circumferential direction, of each circumferential part 29 in the second group is less than the dimension in a circumferential direction of each die face 27.

After the first pass at location 18, dies 20 are retracted radially outwardly from the workpiece and, in the illustrated embodiment, workpiece 10 is rotated in relation to the dies in a first sense (e.g., clockwise, as viewed in Fig. 4) until the second group of circumferential parts 29, which were located at the gaps between adjacent die faces 27 on the first pass, are substantially centered under die faces 27. While the workpiece is undergoing this rotation, the retracted dies remain at axial location 18 on the workpiece.

After the rotating step, the multiplicity of dies 20 is urged radially inwardly on the workpiece, in a second pass, to compress the second group of circumferential parts 29 at axial location 18. Thus, each circumferential part 28, 29 of the workpiece is engaged by a die face during at least one of the first and second passes at axial location 18.

As a result of the two passes at first axial location 18 on the workpiece, initially both the outside diameter and the inside diameter of the workpiece are decreased, until the inside surface 40 of the workpiece contacts the outside surface 41 of mandrel 21. Thereafter, upon further squeezing by dies 20, the inside diameter of the workpiece would not be decreased, but the wall thickness of the workpiece would be decreased. In such a situation, metal flow in the workpiece is accommodated by axial expansion on the part of the workpiece, as will be explained subsequently in more detail.

After the desired dimensions have been attained at first axial location 18, the workpiece is advanced axially so that the multiplicity of dies are positioned at a second predetermined axial location on the workpiece, e.g., at 19, and the procedures performed at 18 are repeated at 19.

If, after the first and second passes at first location 18, the desired dimensions have not been attained, the workpiece is rotated, in relation to the dies, in a second sense, opposite the aforementioned first sense (e.g., in a counterclockwise sense as used in FIG. 4) to return each die to substantially the same angular positions which it occupied in relation to the workpiece during the first pass. Thereafter the steps of urging the dies radially inwardly, in a first pass, rotating the workpiece, and then urging the dies radially inwardly in a second pass are repeated until the desired dimensions for the workpiece are obtained.

When it is necessary to repeat the first and second shrink forming passes in order to obtain the desired final dimensions for the workpiece, the second rotating step, which returns the circumferential parts 28 and 29 to the same positions in relation to die faces 27 as they occupied during the first pass, may be accomplished by rotating the workpiece (or the dies) in the same sense as was used during the first rotating step, rather than rotating in an opposite sense, so long as the angle of rotation is the same as during the first rotating step. More particularly, if the first rotating step was through an angular distance of 15°, then the second rotating step should be through the same angle, whether the second rotating step is in the same sense as the first rotating step or in an opposite sense thereto.

Depending upon the physical properties of the workpiece after the first and second shrink forming passes, it may be necessary to remove the workpiece from the shrink forming machine and subject it to an annealing step before it is subjected to further shrink forming.

The dimensions of the workpiece after deformation by shrink forming are determined by the mandrel and by the extent to which the dies are urged radially inwardly. The inside diameter of the workpiece is determined by the outside diameter of the mandrel at the location where it is contacted by the inside surface of the workpiece. The outside diameter of the workpiece is determined by the point along the radial path of movement of the dies where radially inward movement is stopped. The wall thickness is similarly determined, provided that radially inward movement of the dies continues after the inside surface of the workpiece contacts the outside surface of the mandrel. Variations in inside diameter are obtained with variations in the diameter of the mandrel. Variations in outside diameter and in wall thickness are obtained with variations in the point where radially inward movement of the dies is stopped, and these variations can be obtained without changing the dies.

Referring now to FIGS. 4–7, workpiece 10 undergoes a reduction in diameter during the shrink forming passes without forming a radially outwardly extending extrusion at any of the second group of circumferential parts 29. This is accomplished by providing each die 20 with a die face 27 having a predetermined cross sectional configuration in a circumferential direction and comprising a pair of opposite end portions 31, 32 and an arcuate portion 33 therebetween (FIG. 6). Each of the die face end portions 31, 32 has a relatively flat configuration, and each has a dimension in a substantially circumferential direction substantially less than the dimension in a circumferential direction of arcuate portion 33. As used herein, the term "circumferential direction" refers to the circumference of the circle formed by the die faces in a shrink forming operation.

At the beginning of a pass, with a die face 27 having the configuration of FIG. 6 there is an increase in the initial area of contact between die face 27 and the workpiece, and the initial area of contact is located more toward the middle of the die face, compared to a die face in which the ends thereof came to a sharp point rather than being flattened as at 31 and 32.

Referring to FIG. 7, the cross sectional die face configuration illustrated in FIG. 6 produces, during the first shrink forming pass, metal flow initially in a substantially circumferential direction at each of end portions 31, 32 of the die face, and this avoids the formation of a radially outwardly extending extrusion at any of the second group of circumferential parts 29. The substantially circumferential direction of metal flow at a die face end portion (e.g., 32) is illustrated by arrows 34, 35 in FIG. 7.

The metal flow in the direction of arrow 34, which forms during the initial part of the first pass, is flattened during a subsequent part of the first pass without folding or lapping. The metal flow in the direction of arrow 35 is flattened during the second pass, without folding or lapping. There is relatively little, if any, metal bulge between or within die faces during a pass.

As shown in FIG. 4, in the illustrated embodiment the multiplicity of circumferentially arranged dies comprises twelve dies 20 which are spaced apart at an angular spacing between centers of adjacent dies of about 30°. A permissible angular spacing is in the range of about 20° to 60°.

To prevent torsional deformation of the workpiece when, after the first pass, the workpiece is rotated and then subjected to a second shrink forming pass, the angle of rotation should be about one-half the angular spacing distance between the centers of adjacent dies 20, and the permissible angle of rotation is in the range of about 36% to 64% of the angular spacing between die centers. If the rotation of the workpiece between passes is outside the permissible range set forth in the preceding sentence, there is a danger of torsional deformation in the workpiece, and this is undesirable, for the reasons noted above.

Thus, assuming twelve dies with an angular spacing between die centers of 30°, a preferred angle of rotation is 15° with a permissible deviation of about 3° or 4° on each side of 15°. If there were six dies with an angular spacing of 60° between die centers, the angle of rotation would be about 30° with a permissible deviation of about 6° to 8° on each side of 30°.

In the embodiment discussed above, the workpiece is advanced axially relative to the dies, although, as an alternative, the dies can be moved axially relative to the workpiece. However, the former embodiment is more practical as the dies are usually attached to a large machine which would be more difficult to move in an axial direction than would the workpiece. Usually the workpiece and mandrel are moved together, both axially and rotatably, although they can be individually controlled.

As noted above, both the outside diameter and the wall thickness of the workpiece may be decreased simultaneously during a shrink forming operation in accordance with the present invention. To accommodate the workpiece material displaced as a result of the decrease in both outside diameter and wall thickness, the workpiece is allowed to expand axially. This is accomplished by employing a stop member 37 on mandrel 21 (FIG. 3). Stop member 37 has an end recess 38 for receiving an end 39 of the workpiece. End 39 abuts against the inner surface of recess 38, and this prevents axial expansion from end 39 while leaving free the other end 17 of the workpiece to permit axial expansion from end 17.

There are forces which resist axial expansion when the wall thickness undergoes a decrease. These forces comprise the friction in an axial direction between inside workpiece surface 40 and outside mandrel surface 41 at location 18 and between outside workpiece surface 42 and dies faces 27. There is also a force, imparted by the shrink forming apparatus (not shown) which urges dies 20 radially inward, and the force employed in so urging the dies has a predetermined maximum available for use in performing this operation, depending upon the capacity of the shrink forming apparatus.

In order to effect a decrease in wall thickness, the forces which resist axial expansion must be restricted so that they do not exceed the predetermined force available for urging the dies radially inward. This is accomplished by restricting or controlling the area of contact, at any given axial location on the workpiece (e.g., at 18), between die faces 27, 27 and workpiece outside surface 41. The area of contact is in turn controlled by controlling or reducing the area of die faces 27, 27. For a given area of contact, the force resisting axial expansion will, of course, vary with the coefficient of friction of the contacting materials.

As shown in the drawings, the dimension of the area of contact in a direction transverse to the circumference of the workpiece, during the totality of a pass, is relatively small compared to the axial dimension of the workpiece and to the inside diameter thereof when the inner surface of the workpiece contacts the outer surface of the mandrel.

Reducing the area of die faces 27, 27 concentrates the entire shrink forming force at a relatively small area of contact at location 18 (or any other location along the workpiece) and reduces the friction opposing axial expansion. If the maximum force available for shrink forming is not enough to produce a decrease in wall thickness, the area of die faces 27, 27 should be reduced (by providing a set of dies with smaller die faces) until a decrease in wall thickness is obtained.

Generally, the force needed to obtain a reduction at a given location on a tubular metal workpiece is in the range 80,000–400,000 psi for a material such as Inconel 718, a nickel-iron alloy containing about 40% iron and having strength characteristics about 50% greater than mild steel. The range 80,000–400,000 psi reflects both (a) the force needed to deform the workpiece, in the abstract (i.e., without considering the forces which resist axial expansion), and (b) the force needed to overcome the afore-mentioned forces which resist axial expansion of the workpiece. As the workpiece undergoes reduction, the force required to produce further reduction increases because of work hardening of the workpiece. As that force increases, a condition is approached at which the workpiece should undergo annealing to offset the effects of work hardening before further attempts are made to reduce the workpiece.

The foregoing detailed description has been given for clearness of understanding only, and no unnecessary limitations should be understood therefrom, as modifications will be obvious to those skilled in the art.

I claim:

1. A method for radially forging by shrink forming a tubular workpiece having a circular cross-section, said method comprising the steps of:

surrounding the circumference of said workpiece with a multiplicity of closely spaced dies having die faces and positioned at a first predetermined axial location on the workpiece;

the annular spacing between the centers of adjacent dies being no more than about 60°;

urging said multiplicity of dies radially inwardly on said workpiece without swaging, in a first pass, to squeeze the workpiece and decrease the outside diameter thereof at said first predetermined axial location;

engaging, with each of said die faces during said urging step, a respective one of a first group of circumferential parts of the workpiece, there being a second group of circumferential parts located between die faces during said first pass;

the dimension, in a circumferential direction, of each circumferential part in said second group being less than the dimension in a circumferential direction of each die face adjacent said circumferential part;

retracting said dies radially outwardly after said first pass;

rotating one of (a) said multiplicity of dies or (b) said workpiece, in relation to the other, in a first sense, until said second group of circumferential parts, which were located between die faces on said first pass, are substantially centered under said die faces;

the position of said dies at said first predetermined axial location being maintained during said rotating step;

urging said multipicity of dies radially inwardly on said workpiece without swaging, in a second pass, to compress the second group of circumferential parts at said first predetermined axial location;

each circumferential part of said workpiece being engaged by a die face during at least one of said first and second passes at said first predetermined axial location;

and subjecting said workpiece to deformation during said passes without forming a radially outwardly extending extrusion at any of said second group of circumferential parts.

2. A method as recited in claim 1 and comprising:

axially advancing said workpiece so that said multiplicity of dies are positioned at a second predetermined axial location on the workpiece, after at least the outside diameter of said workpiece has undergone a predetermined reduction at said first predetermined axial location.

3. A method as recited in claim 1 and comprising:

after said second pass, rotating one of (a) said multiplicity of dies or (b) said workpiece, in relation to the other, to return said dies to substantially the same angular positions on said circumferential parts which they occupied in relation to said workpiece during said first pass;

and then repeating said first-recited urging step, said first-recited rotating step and said second-recited urging step.

4. A method as recited in claim 3 and comprising:

axially advancing said workpiece so that said multiplicity of dies are positioned at a second predetermined axial location on the workpiece, after at least the outside diameter of said workpiece has undergone a predetermined reduction at said first predetermined axial location.

5. A method as recited in claim 1 and comprising:

providing each of said dies with a die face having a predetermined cross-sectional configuration in a circumferential direction and comprising a pair of opposite end portions and an arcuate portion therebetween;

said cross-sectional configuration producing, during said first recited urging step, metal flow initially in a circumferential direction at each of said end portions of the die face while avoiding the formation of a radially outwardly extending extrusion at any of said second group of circumferential parts.

6. A method as recited in claim 5 wherein said providing step comprises:

providing each of said die face end portions with a relatively flat configuration.

7. A method as recited in claim 6 and comprising:

providing each of said die face end portions with a dimension in a substantially circumferential direction substantially less than the dimension in a circumferential direction of said arcuate portion.

8. A method as recited in claim 5 wherein said providing step comprises:

relieving said die face at each of said end portions

9. A method as recited in claim 1 wherein:

said rotating step encompasses an angle of rotation sufficient to avoid torsional deformation as a result of urging said dies radially inwardly in a pass occurring after said rotating step.

10. A method as recited in claim 9 wherein:

said angle of rotation comprises about 36% to 64% of the angular spacing between the centers of adjacent dies.

11. A method as recited in claim 10 wherein said angular spacing is in the range of about 20° to 60°.

12. A method for radially forging by shrink forming a tubular workpiece having a circular cross-section and inside and outside surfaces, said method comprising the steps of:

contacting the outside surface of said workpiece with a multiplicity of closely spaced dies surrounding said workpiece and positioned at a first predetermined axial location on the workpiece;

the angular spacing between centers of adjacent dies being no more than about 60°;

locating inside said tubular workpiece a mandrel having an outer surface portion axially aligned with said first predetermined axial location;

urging said multiplicity of dies radially inwardly on said workpiece, without swaging, initially to squeeze the workpiece and to decrease the outside diameter and increase the thickness of the workpiece at said first predetermined axial location, until the inside surface of the tubular workpiece contacts said outer surface portion of the mandrel;

urging said dies radially inwardly without swaging, after the inside surface of the workpiece has contact said outer surface portion of the mandrel, to further squeeze the workpiece and decrease simultaneously both the outside diameter and the wall thickness of the workpiece;

allowing axial expansion of said workpiece to accomodate the totality of the workpiece material displaced as a result of the decrease in both said outside diameter and said wall thickness;

and restricting the area of contact, at said first predetermined axial location, between said dies and the outside surface of the workpiece, to decrease the friction in an axial direction between the outside surface of the workpiece and said dies and between the inside surface of the workpiece and said outer surface portion of the mandrel;

the dimension of said area of contact in a direction transverse to the circumference of the workpiece, during the totality of said two urging steps, being relatively small compared to the axial dimension of the workpiece and to the inside diameter thereof when the inner surface of the workpiece contacts the outer surface portion of the mandrel;

the totality of the movement of said dies during the squeezing of said workpiece being in a radial direction.

13. A method as recited in claim 12 and comprising:

engaging one end of said tubular workpiece with stop means to prevent axial expansion from that end while leaving free the other end of the workpiece to permit axial expansion from the other end.

14. A method as recited in claim 12 wherein said urging steps are performed during a first pass, said method further comprising:

retracting said dies radially outwardly after said first pass;

rotating one of (a) said multiplicity of dies or (b) said workpiece, in relation to the other, in a first sense, through a predetermined angle of rotation;

the position of said dies at said first predetermined axial location being maintained during said rotating step;

and then urging said multiplicity of dies radially inwardly on said workpiece, in a second pass, to deform said workpiece.

15. A method as recited in claim 14 and comprising:

axially advancing said workpiece so that said multiplicity of dies are positioned at a second predetermined axial location on the workpiece, after said workpiece has undergone a predetermined deformation at said first predetermined axial location;

and then repeating said first pass, said first recited rotating step and said second pass to deform said workpiece at said second predetermined axial location to produce a different outside diameter than at said first predetermined axial location, and reduce the wall thickness of the workpiece, without changing said dies.

16. A method as recited in claim 14 and comprising:

after said second pass, rotating one of (a) said multiplicity of dies or (b) said workpiece, in relation to the other, to return said dies to substantially the same angular positions which they occupied in relation to said workpiece during said first pass;

and then repeating at least said first pass.

17. A method as recited in claim 16 and comprising:

axially advancing said workpiece so that said multiplicity of dies are positioned at a second predetermined axial location on the workpiece, after said workpiece has undergone a predetermined deformation at said first predetermined axial location;

and then repeating said first pass, said first recited rotating step and said second pass to deform said workpiece at said second predetermined axial location to produce a different outside diameter than at said first predetermined axial location, and reduce the wall thickness of the workpiece, without changing said dies.

18. A method as recited in claim 14 wherein:

said rotating step encompasses an angle of rotation sufficient to avoid torsional deformation as a result of urging said dies radially inwardly in a pass occurring after said rotating step.

19. A method as recited in claim 18 wherein:

said angular spacing is in the range of about 20° to 60°.

20. A method as recited in claim 12 wherein:

the angular spacing between the centers of adjacent dies is in the range of about 20° to 60°.

21. A method as recited in claim 18 wherein:

said angle of rotation comprises about 36% to 64% of the angular spacing between the centers of adjacent dies.

* * * * *